US011186457B2

(12) United States Patent
Nonoyama et al.

(10) Patent No.: US 11,186,457 B2
(45) Date of Patent: Nov. 30, 2021

(54) SHEET CONVEYANCE APPARATUS, IMAGE READING APPARATUS, AND IMAGE FORMING APPARATUS

(71) Applicant: Konica Minolta Inc., Tokyo (JP)

(72) Inventors: Masahiro Nonoyama, Toyokawa (JP); Masahiro Kamiya, Toyohashi (JP); Katsuhide Sakai, Toyokawa (JP); Junichi Masuda, Toyokawa (JP); Taku Kimura, Toyokawa (JP)

(73) Assignee: KONICA MINOLTA INC., Tokyo (JP)

( * ) Notice: Subject to any disclaimer, the term of this patent is extended or adjusted under 35 U.S.C. 154(b) by 39 days.

(21) Appl. No.: 16/834,160

(22) Filed: Mar. 30, 2020

(65) Prior Publication Data

US 2020/0307935 A1 Oct. 1, 2020

(30) Foreign Application Priority Data

Mar. 29, 2019 (JP) ..... JP2019-065638

(51) Int. Cl.
*B65H 7/12* (2006.01)
*B65H 7/14* (2006.01)
*B65H 5/36* (2006.01)

(52) U.S. Cl.
CPC ..... *B65H 7/125* (2013.01); *B65H 5/36* (2013.01); *B65H 7/14* (2013.01); *B65H 2511/524* (2013.01); *B65H 2553/30* (2013.01)

(58) Field of Classification Search
CPC ... B65H 5/36; B65H 5/38; B65H 7/12; B65H 7/125; B65H 2511/13; B65H 2511/524;
(Continued)

(56) References Cited

U.S. PATENT DOCUMENTS

2005/0127597 A1* 6/2005 Sano ..... B65H 7/125 271/258.01
2012/0138676 A1* 6/2012 Ma ..... B65H 7/12 235/379
2020/0039774 A1* 2/2020 Yamada ..... G01N 29/11

FOREIGN PATENT DOCUMENTS

CN 102030207 A 4/2011
CN 109387562 A 2/2019
(Continued)

OTHER PUBLICATIONS

CNIPA First Office Action for corresponding CN Application No. 202010216214.8; dated, Jul. 29, 2021.

*Primary Examiner* — Prasad V Gokhale
(74) *Attorney, Agent, or Firm* — Cantor Colburn LLP

(57) ABSTRACT

Provided is a sheet conveyance apparatus armored with a housing, the sheet conveyance apparatus includes: a sheet conveyor that feeds a sheet to a downstream side in a direction of conveyance; a conveyance guide that guides the sheet to be conveyed; an ultrasonic sensor that detects the sheet guided by the conveyance guide; and a shield member that is conductive, wherein the ultrasonic sensor includes: a transmitter that transmits an ultrasonic wave having a predetermined frequency; and a receiver that receives the ultrasonic wave, the transmitter and the receiver are arranged along the conveyance guide, and the shield member is disposed between the housing and the receiver in a sheet-face perpendicular direction at an ultrasonic-irradiation position of the sheet being conveyed, the shield member covering an entirety of the receiver in plan view in the sheet-face perpendicular direction.

19 Claims, 11 Drawing Sheets

(58) Field of Classification Search
CPC ..... B65H 2515/82; B65H 2553/30; B65H 2601/521
See application file for complete search history.

(56) References Cited

FOREIGN PATENT DOCUMENTS

| | | | |
|---|---|---|---|
| JP | 2016159986 | A | 9/2016 |
| JP | 2017052582 | A | 3/2017 |

* cited by examiner

100

SHEET CONVEYANCE APPARATUS, IMAGE READING APPARATUS, AND IMAGE FORMING APPARATUS

CROSS REFERENCE TO RELATED APPLICATION

The present invention claims priority under 35 U.S.C. § 119 to Japanese Application No. 2019-065638 filed Mar. 29, 2019, the entire content of which is incorporated herein by reference.

BACKGROUND

Technological Field

The present invention relates to a sheet conveyance apparatus, an image reading apparatus, and an image forming apparatus, and particularly relates to a technology of detecting sheet double feed with accuracy.

Description of the Related art

Conventionally, at the time of reading of a document in a sheet-fed manner, if an automatic document feeder (ADF) that automatically conveys a document to a scanner causes double feed in which two documents or more overlapping mutually are conveyed, the documents are difficult to read correctly. Thus, the automatic document feeder is provided with a double-feed detection sensor that detects document double feed. When double feed is detected, the automatic document feeder stops conveying the documents and then notifies a user of the occurrence of the double feed.

In a case where an ultrasonic sensor is used as the double-feed detection sensor, a transmitter transmits an ultrasonic wave to a sheet and a receiver receives the ultrasonic wave having passed through the sheet or the ultrasonic wave reflected from the sheet. Then, the degree of intensity of the ultrasonic wave is determined, resulting in detection of the presence or absence of double feed. Because the receiver of the double-feed detection sensor receives the ultrasonic wave having weakened through the sheet and then generates a detection signal on the basis thereof, the detection signal is weak. Thus, the detection signal receives the influence of noise easily, so that erroneous determination of double feed is likely to be made.

In order to solve such a problem, for example, a sheet conveyance apparatus has been proposed in which a double-feed detection sensor is directly grounded at a feeder casing through no conveyance guide that guides a sheet (refer to JP 2017-052582 A). This arrangement enables, in a case where a sheet that the conveyance guide guides is electrically charged, noise from a metallic part influenced by the charged sheet near the conveyance guide, to be inhibited from being superimposed onto a detection signal of the double-feed detection sensor. Thus, erroneous determination of double feed can be prevented.

However, because an image processing apparatus, such as a scanner or a copier, needs space saving in general, a sheet conveyance apparatus to be mounted on such an apparatus has been continuously improved for downsizing. Due to such downsizing, the distance from the double-feed detection sensor to the exterior of the sheet conveyance apparatus is short. Thus, the double-feed detection sensor easily receives influence from the outside of the sheet conveyance apparatus in addition to inside the sheet conveyance apparatus, so that erroneous determination of double feed is likely to occur.

SUMMARY

The present invention has been made in consideration of such a problem, and an object of the present invention is to provide a sheet conveyance apparatus, an image reading apparatus, and an image forming apparatus that enable prevention of erroneous determination from a double-feed detection sensor due to external influence.

To achieve the abovementioned object, according to an aspect of the present invention, there is provided a sheet conveyance apparatus armored with a housing, and the sheet conveyance apparatus reflecting one aspect of the present invention comprises: a sheet conveyor that feeds a sheet to a downstream side in a direction of conveyance; a conveyance guide that guides the sheet to be conveyed; an ultrasonic sensor that detects the sheet guided by the conveyance guide; and a shield member that is conductive, wherein the ultrasonic sensor includes: a transmitter that transmits an ultrasonic wave having a predetermined frequency; and a receiver that receives the ultrasonic wave, the transmitter and the receiver are arranged along the conveyance guide, and the shield member is disposed between the housing and the receiver in a sheet-face perpendicular direction at an ultrasonic-irradiation position of the sheet being conveyed, the shield member covering an entirety of the receiver in plan view in the sheet-face perpendicular direction.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, a sheet conveyance apparatus, an image reading apparatus, and an image forming apparatus according to one or more embodiments of the present invention will be described with reference to the drawings. However, the scope of the invention is not limited to the disclosed embodiments.

[1] Configuration of Image Forming Apparatus

First, the configuration of the image forming apparatus according to the present embodiment, will be described.

Figure 1:
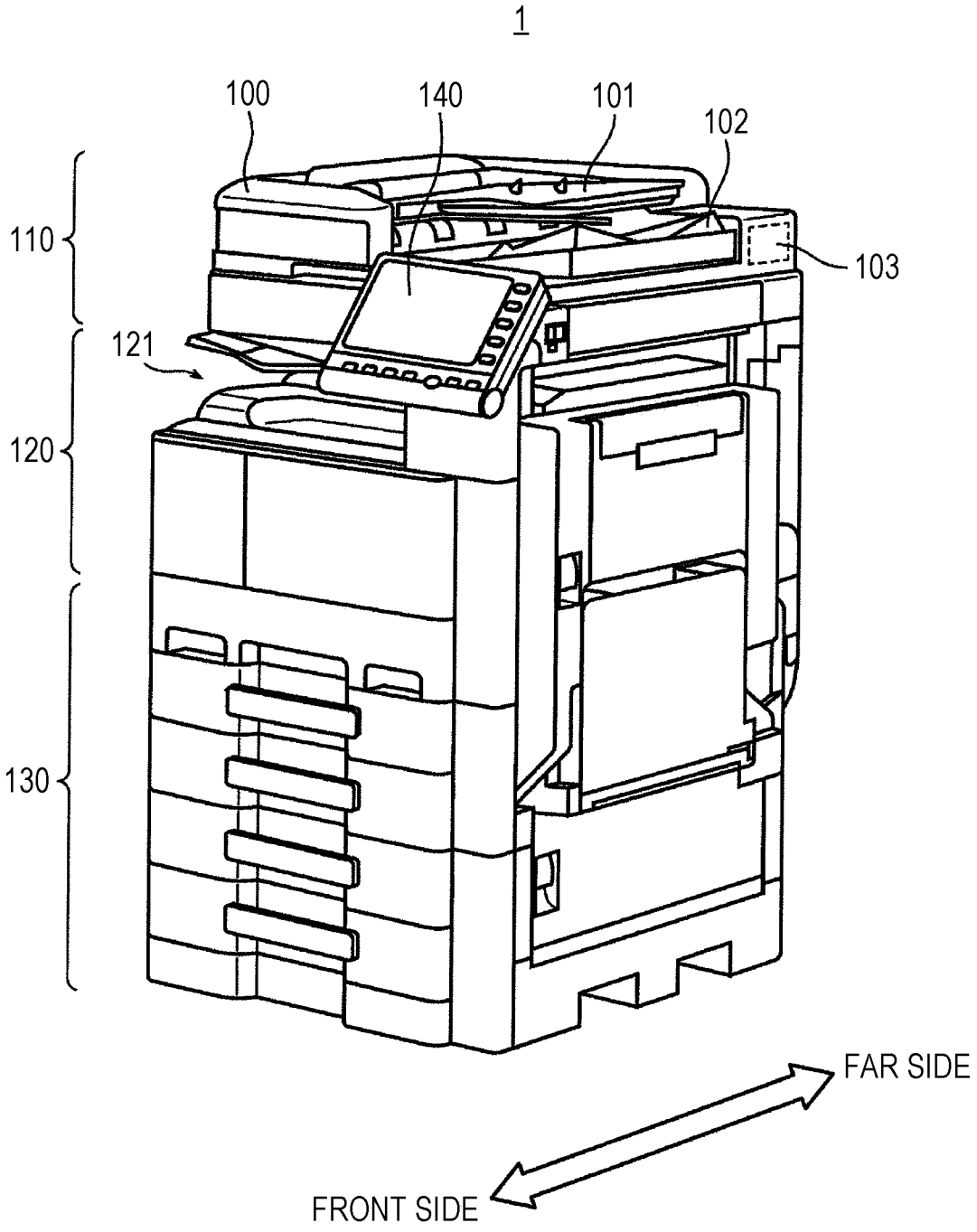
FIG. 1 is a perspective external view of a main configuration of an image forming apparatus according to an embodiment of the present invention.

The image forming apparatus according to the present embodiment is a so-called multi-function peripheral (MFP). As illustrated in FIG. 1, the image forming apparatus includes an image reader 110, an image former 120, and a paper feeder 130, in which the image reader 110 is provided with a sheet conveyance apparatus 100. From a sheaf of documents set in a document tray 101, the sheet conveyance apparatus 100 feeds each document on a one-by-one basis, and then discharges the document read by the image reader 110 in a so-called sheet-fed manner, onto a discharge tray 102. In this manner, image data is generated. Note that the sheet conveyance apparatus 100 including a controller 103 receives a detection signal from a double-feed detection sensor, to detect double feed.

The image former 120 includes an image creator that forms a toner image and transfers the toner image to a recording sheet and a fixer that thermally fixes the toner image on the recording sheet. The image former 120 performs image forming processing with the image data generated by the image reader 110 or image data received through a communication network, such as a local area network (LAN) or the Internet. The paper feeder 130 housing recording sheets supplies a recording sheet at the same time that the image former 120 forms a toner image. The recording sheet on which the toner image transferred is thermally fixed, is discharged to a discharge tray 121 provided in the internal space of the multi-function peripheral 1.

The multi-function peripheral 1 including an operation panel 140 presents information to a user of the multi-function peripheral 1 or receives an instruction input from the user. In the following, with respect to the front face of the operation panel 140, the near side is referred to as the "front side" and the far side is simply referred to as the "far side".

[2] Configuration of Sheet Conveyance Apparatus 100

Next, the configuration of the sheet conveyance apparatus 100 will be specifically described.

Figure 2:
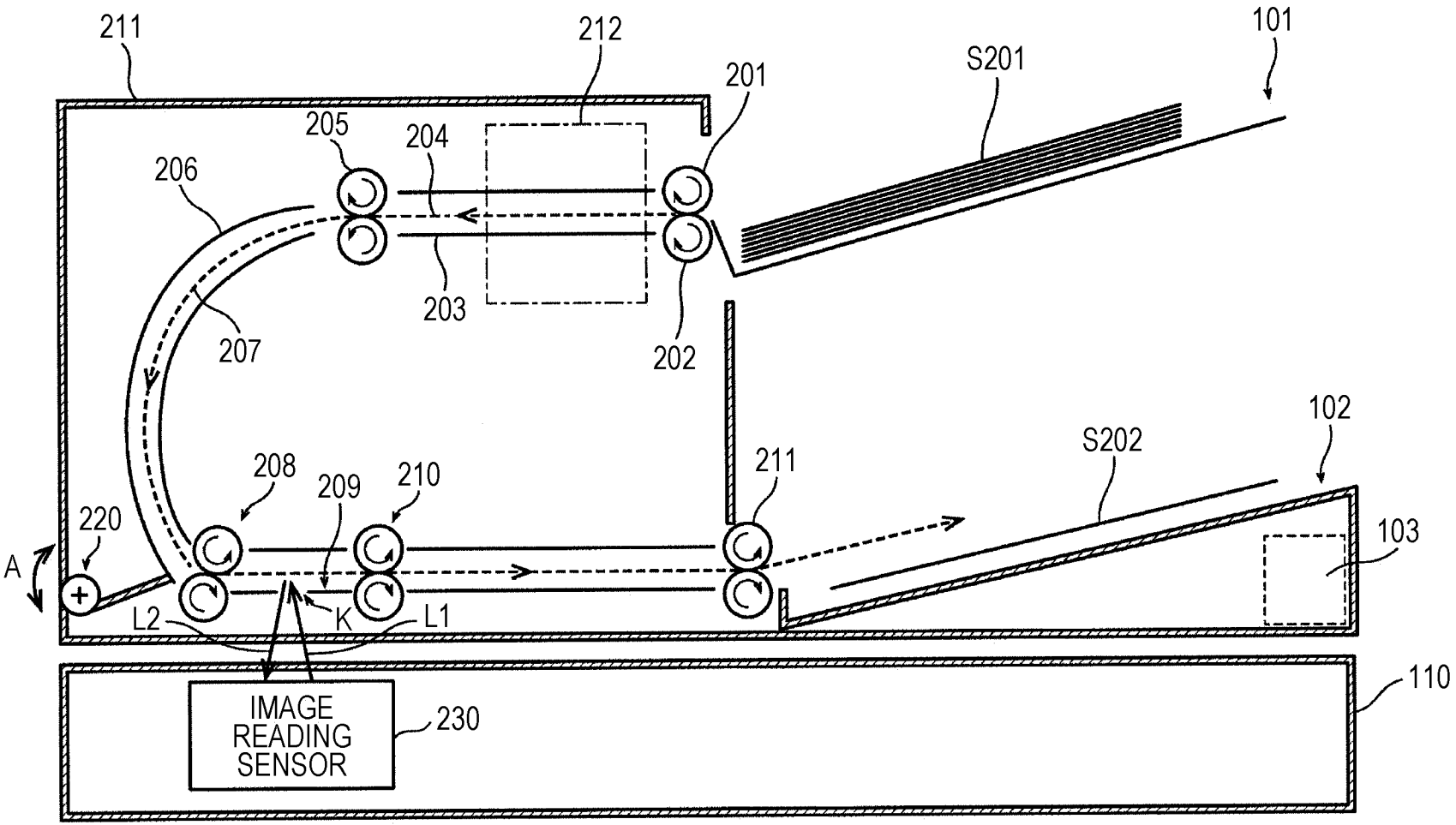
FIG. 2 illustrates a main configuration of a sheet conveyance apparatus.

As illustrated in FIG. 2, from a sheaf of sheets S201 loaded on the document tray 101, the sheet conveyance apparatus 100 sequentially separately feeds each sheet on a one-by-one basis in the direction of an arrow 204 along a conveyance guide 203, with a feed roller 201 and a separation roller 202. In this case, the feed roller 201 rotates so as to feed the uppermost sheet of the sheaf of sheets S201 in the direction of the arrow 204. Meanwhile, the separation roller 202 rotates in the direction of rotation of the feed roller 201, to convey a sheet different from the uppermost sheet in the opposite direction of the arrow 204 such that the sheet different from the uppermost sheet is not double-fed. Note that, in a case where a different sheet clings tightly to the uppermost sheet due to static electricity or ink, the separation roller 202 is likely to be insufficient to prevent double feed.

Paired registration rollers 205 stopping in rotation, causes the sheet to form a loop, due to a collision with the front end of the sheet, so that the skew of the sheet is corrected. After the correction of the skew, the paired registration rollers 205 rotate, so that the sheet is conveyed in the direction of an arrow 207 along a conveyance guide 206. Furthermore, the sheet is conveyed by paired conveyance rollers 208 and paired conveyance rollers 210, and then is discharged by paired discharge rollers 211. The discharged sheet is loaded on the discharge tray 102.

With an image reading sensor 230 secured at the sheet reading position, the image reader 110 reads an image from a sheet that the sheet conveyance apparatus 100 conveys, to generate image data. In this case, the image reading sensor 230 irradiates the sheet with reading light L1 through a slit K provided at a conveyance guide 209 of the sheet conveyance apparatus 100. Then, the image reading sensor 230 detects reflected light L2 from the sheet, to acquire the strength at each position on the sheet.

In the sheet conveyance apparatus 100 having an exterior (housing) 211 made of resin, the double-feed detection sensor is disposed in an area 212 for arrangement of the double-feed detection sensor, on the downstream side in the direction of sheet conveyance of the feed roller 201. The double-feed detection sensor detects sheet double feed with an ultrasonic wave. The conveyance guides 203, 206, and 209 are each made of resin.

The cover portion of the exterior 211 is supported pivotably in the direction of an arrow A about a pivot shaft 220. In a case where a sheet jam (paper jam) occurs in the sheet conveyance apparatus 100, the route of sheet conveyance is exposed by a pivot of the cover portion. Then, the jammed paper is removed, resulting in release of the jam.

[3] Configuration of Controller 103

Next, the configuration of the controller 103 will be described.

Figure 3:
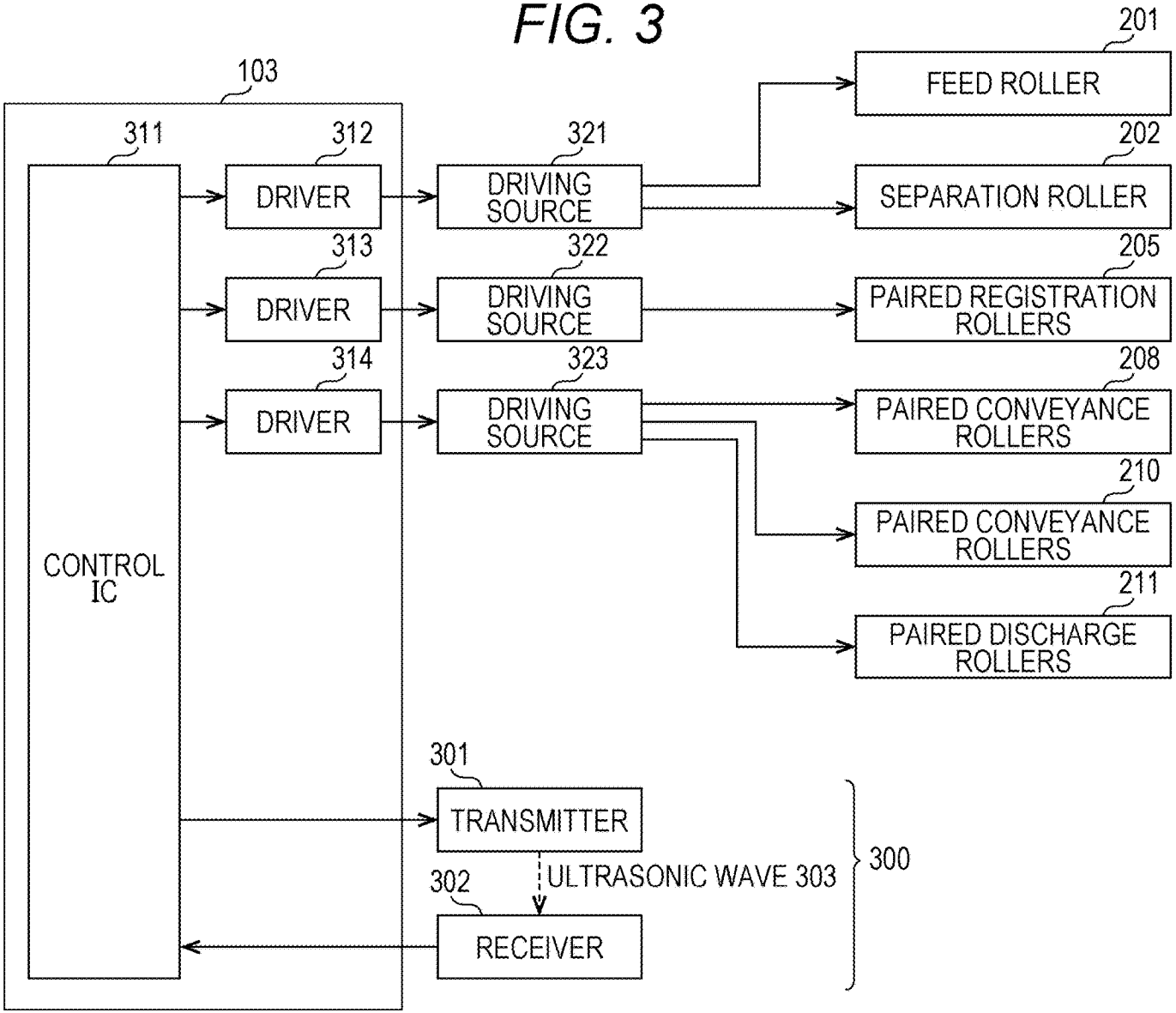
FIG. 3 is a block diagram of a main configuration of a controller.

The controller 103 that is a so-called control board, includes, as illustrated in FIG. 3, a control integrated circuit (IC) 311 and drivers 312, 313, and 314. Under control of the control IC 311, the driver 312 inputs a control signal (e.g., a pulse width modulation (PWM) signal) into a driving source 321 such that the feed roller 201 and the separation roller 202 are rotation-driven.

The driver 313 inputs a control signal into a driving source 322 such that the paired registration rollers 205 are rotation-driven, so that the skew of a sheet is corrected and the sheet after the correction of the skew is conveyed. The driver 314 inputs a control signal into a driving source 323 such that the paired conveyance rollers 208, the paired conveyance rollers 210, and the paired discharge rollers 211 are rotation-driven, so that the sheet is conveyed to the discharge tray 102.

Furthermore, the control IC 311 inputs a control signal into a transmitter 301 such that an ultrasonic wave 303 is transmitted. A receiver 302 receives the ultrasonic wave 303 and then outputs a detection signal corresponding to the intensity of the ultrasonic wave 303, to the control IC 311. The transmitter 301 and the receiver 302 included in the double-feed detection sensor (ultrasonic sensor) 300 are disposed in the area for arrangement of the double-feed detection sensor.

Figure 4:
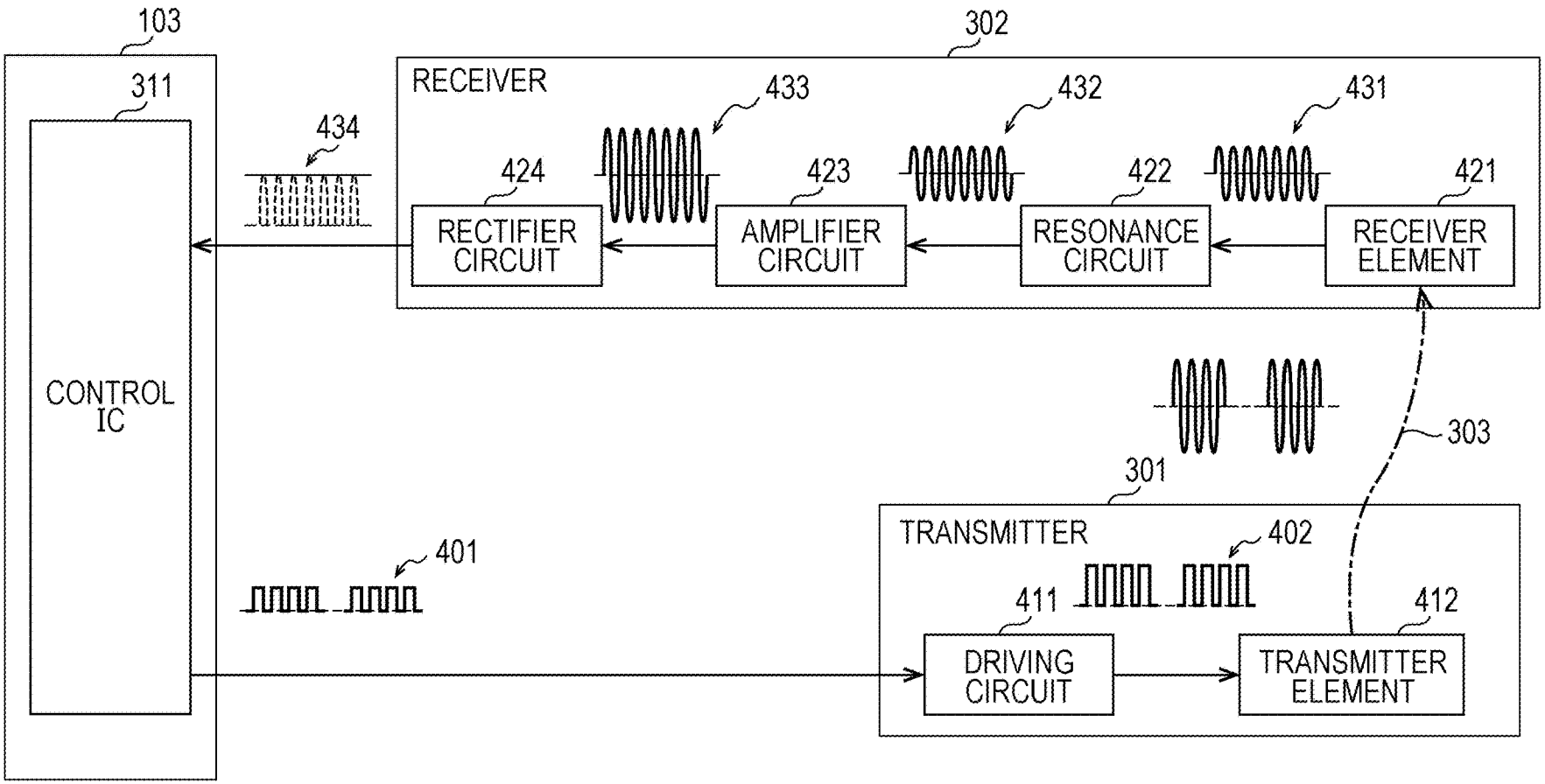
FIG. 4 is a block diagram of respective main configurations of a transmitter and a receiver included in a double-feed detection sensor.

As illustrated in FIG. 4, the transmitter 301 includes a driving circuit 411 and a transmitter element 412. The driving circuit 411 inputs a driving signal into the transmitter element 412, in accordance with the control signal (pulse signal in the present embodiment) 401 output from the control IC 311. The transmitter element 412 transmits the ultrasonic wave 303 having a frequency of 300 kHz to the route of sheet conveyance, in accordance with the driving signal (pulse signal in the present embodiment) 402 output from the driving circuit 411.

Figure 5:
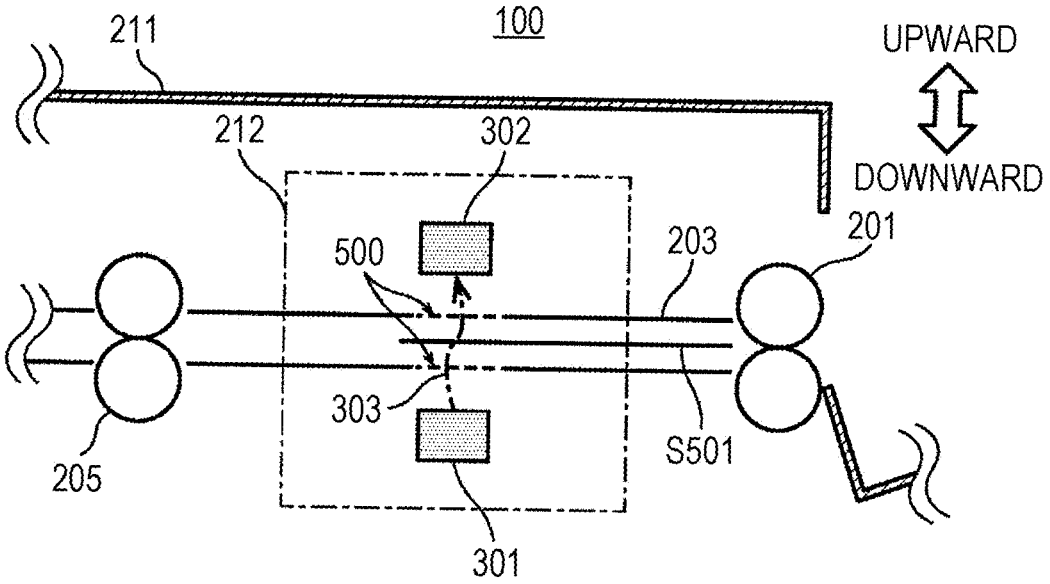
FIG. 5 explanatorily illustrates the position of arrangement of the transmitter and the receiver.

In the present embodiment, as illustrated in FIG. 5, the transmitter 301 and the receiver 302 are opposed to each other across the conveyance guide 203. The transmitter 301 is disposed below the conveyance guide 203. The receiver 302 is disposed above the conveyance guide 203 and between the conveyance guide 203 and the exterior 211 of the sheet conveyance apparatus 100. The conveyance guide 203 is provided with a through hole 500 for allowing the ultrasonic wave 303 to pass therethrough, interposed between the transmitter 301 and the receiver 302.

The transmitter 301 and the receiver 302 are arranged such that the travel route of the ultrasonic wave 303 from the transmitter 301 to the receiver 302 is orthogonal to a sheet principal plane. In a case where a sheet is being conveyed, the ultrasonic wave 303 having passed through the sheet reaches the receiver 302. The intensity of the ultrasonic wave 303 that reaches the receiver 302 decreases as the number of sheets increases. Thus, the presence or absence of double feed can be determined on the basis of whether the intensity is a predetermined threshold or less.

Arrangement of the receiver 302 above the conveyance guide 203 enables the accuracy of detection of the ultrasonic wave 303 to be inhibited from deteriorating due to adhesion of paper powder falling from the sheet being conveyed, or enables the receiver 302 to be inhibited from operating erroneously due to a short circuit caused by a fallen clip or staple. Particularly, considering that a similar effect can be acquired even without a protective member as disclosed in JP 2016-159986 A, saving can be achieved in component cost and in other cost with respect to the conventional technology.

The receiver 302 includes a receiver element 421, a resonance circuit 422, an amplifier circuit 423, and a rectifier circuit 424. The receiver element 421 outputs a reception signal 431 corresponding to the received ultrasonic wave. The resonance circuit 422 is a frequency filter that extracts a frequency component of 300 kHz corresponding to the ultrasonic wave 303, from the reception signal 431 output from the receiver element 421. The resonance circuit 422 outputs an extracted frequency signal 432.

The amplifier circuit 423 amplifies the frequency signal 432 output from the resonance circuit 422, and then outputs an amplified signal 433 that is the amplified frequency signal 432. The rectifier circuit 424 rectifies the amplified signal 433 output from the amplifier circuit 423, generates a rectified signal 434 that is the rectified amplified signal 433, and inputs the rectified signal 434 into the control IC 311. As the intensity of the ultrasonic wave 303 lowers, the voltage value of the rectified signal 434 comes close to a direct-current bias value.

The control IC 311 determines the presence or absence of double feed, with reference to the voltage value of the rectified signal 434, which is an analog signal.

In addition, the control IC 311 is connected with sensors that detect the front end and rear end of a sheet, a sheet jam (paper jam), and the stay thereof, on the route of sheet conveyance from the document tray 101 to the discharge tray 102. The control IC 311 receives a detection signal output from each sensor.

[4] Protection Against Noise

Next, a configuration for protection against noise will be described, in which the double-feed detection sensor 300 is prevented from deteriorating in the accuracy of detection.

Figure 6:
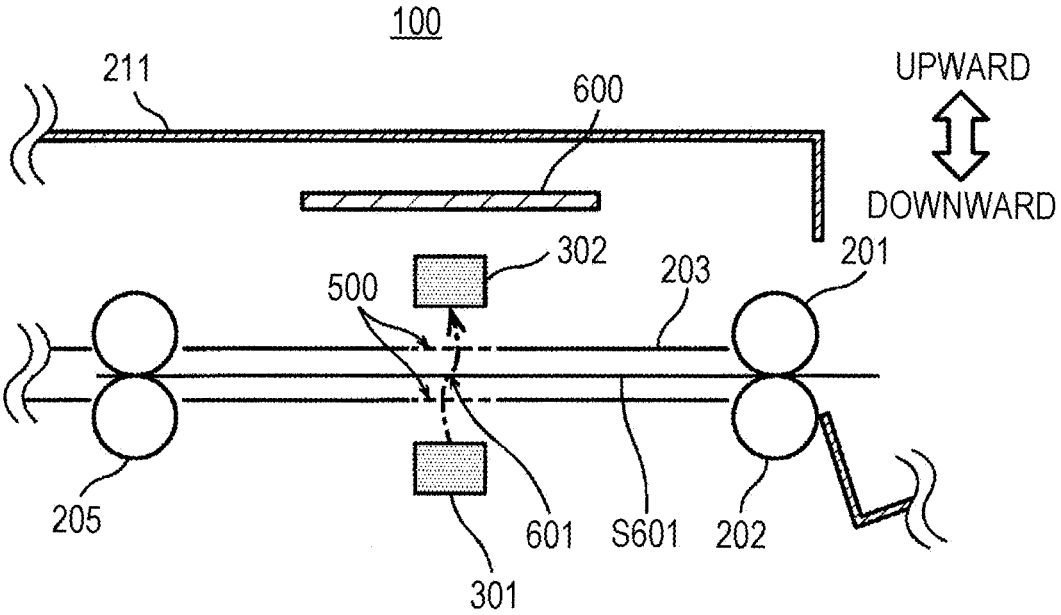
FIG. 6 explanatorily illustrates the position of arrangement of a conductive shield member.

As illustrated in FIG. 6, a tabular conductive shield member 600 is arranged between the receiver 302 and the exterior 211 of the sheet conveyance apparatus 100 in the sheet-face perpendicular direction of a sheet S601 being conveyed (identical to the upward and downward direction in FIG. 6) at the ultrasonic-irradiation position 601 of the sheet S601. With respect to the receiver 302 in the sheet-face perpendicular direction, the conductive shield member 600 is arranged on the side on which a dielectric, such as a hand of the user, outside the sheet conveyance apparatus 100 approaches the receiver 302 during sheet conveyance of the sheet conveyance apparatus 100.

The conductive shield member 600 is larger in size than the receiver 302 in plan view in the sheet-face perpendicular direction (upward and downward direction), and thus covers at least the entirety of the receiver 302 from above.

Note that the conductive shield member 600 may expand in width from the far side to the front side of the sheet conveyance apparatus 100. This is because the user of the multi-function peripheral 1 is likely to extend a hand onto the receiver 302 at any angle on the front side. Expansion of the width on the front side of the conductive shield member 600 enables effective shielding against the influence of such a hand. Meanwhile, the user is less likely to extend a hand on the far side. Thus, reduction of the width on the far side of the conductive shield member 600 enables downsizing of the conductive shield member 600 without loss of the shield effect of the conductive shield member 600. Thus, reduction in cost can be achieved.

Examples of the shape of the conductive shield member 600 include a trapezoid and a fan shape. Needless to say, regardless of the shape of the conductive shield member 600, as long as the conductive shield member 600 has a sufficiently large area and covers the entirety of the receiver 302 and the periphery thereof in the plan view, the accuracy of double-feed detection can be reliably prevented from deteriorating.

In the present embodiment, an exemplary case where the conductive shield member 600 is attached to the cover portion of the exterior 211, will be described. Needless to say, the conductive shield member 600 may be attached to a part different from the cover portion.

Figure 7A:
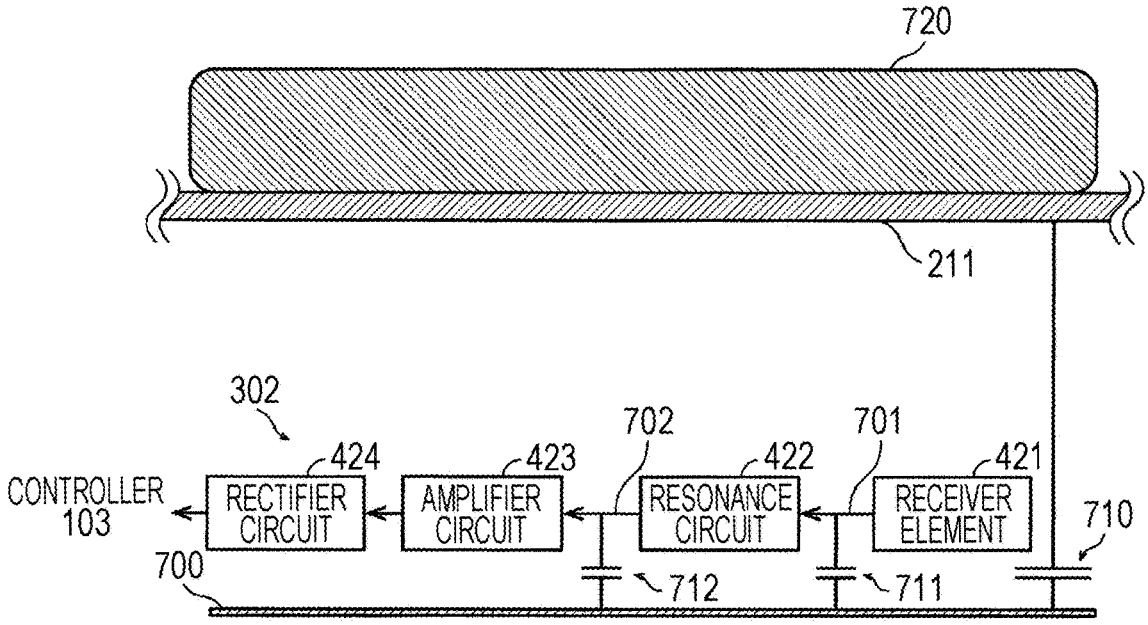
FIG. 7A explanatorily illustrates occurrence of capacitance without the conductive shield member.

As illustrated in FIG. 7A, parasitic capacitance 711 occurs between a wired line 701 from the receiver element 421 to the resonance circuit 422 and the ground potential of a circuit board 700 included in the receiver 302 (hereinafter, referred to as a "board GND"), and parasitic capacitance 712 occurs between a wired line 702 from the resonance circuit 422 to the amplifier circuit 423 and the board GND. However, because the parasitic capacitances 711 and 712 are small in capacitance, no noise propagates from the board GND to the wired lines 701 and 702, respectively, through the parasitic capacitances 711 and 712.

However, with the exterior 211 and the circuit board 700 at a short distance due to the sheet conveyance apparatus 100 downsized, for example, when the user of the sheet conveyance apparatus 100 puts a hand 720 on the exterior 211, capacitance 710 occurs between the hand 720 and the circuit board 700. The capacitance 710 is significantly larger than the respective parasitic capacitances 711 and 712 between the circuit board 700 and the wired lines 701 and 702, and thus allows high-frequency noise to pass therethrough. As a result, electric charge accumulated in the parasitic capacitances 711 and 712 is allowed to move, so that the high-frequency noise propagates to the wired lines 701 and 702.

For example, an image forming apparatus for use on a ship is supplied with alternating-current power with an alternating-current automatic voltage regulator (AVR). In such a case, because the alternating-current automatic voltage regulator generates an arbitrary alternating-current waveform in accordance with a switching operation, switching noise resulting from the alternating-current automatic voltage regulator is superimposed on the board GND. Thus, the switching noise is likely to propagate to the wired lines 701 and 702.

Because the reception signal 431 and the frequency signal 432, respectively, on the wired lines 701 and 702 from the receiver element 421 to the amplifier circuit 423 are small in amplitude and low in S/N ratio, the reception signal 431 and the frequency signal 432 receive the influence of noise easily. Thus, the rectified signal 434 that the receiver 302 finally outputs varies significantly due to the influence of noise. As above, the small distance between the exterior 211 of the sheet conveyance apparatus 100 and the circuit board 700 due to the downsizing, causes the influence of noise to increase, resulting in erroneous determination of double feed.

Because the capacitance varies significantly due to the present or absence of a hand of the user, the influence of noise varies significantly.

Figure 7B:
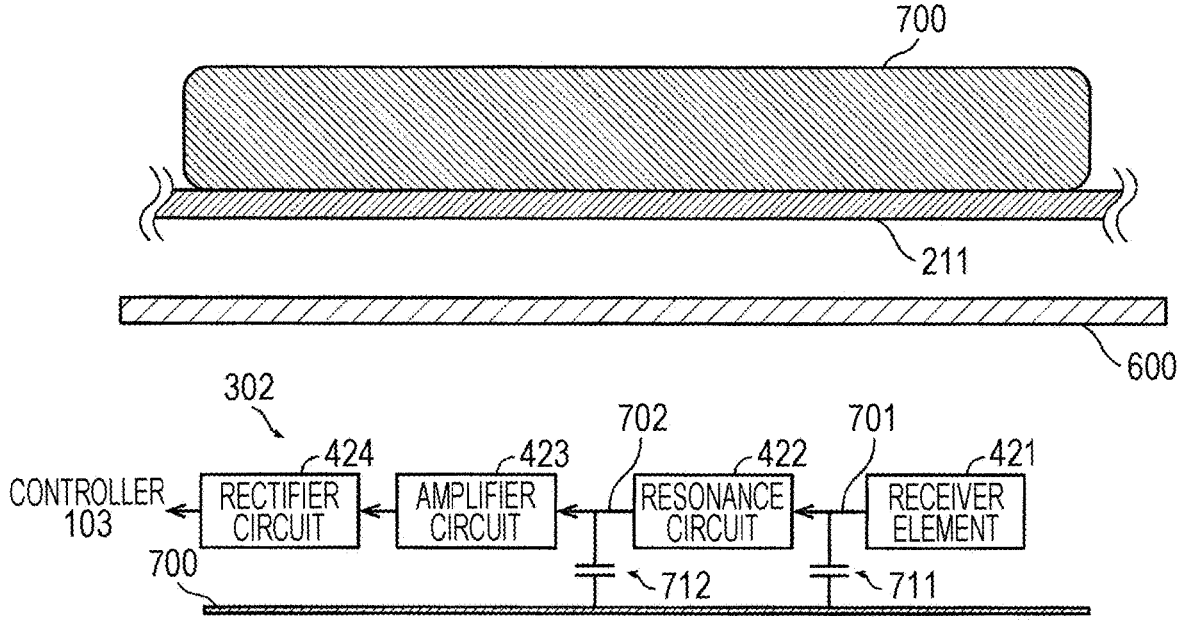
FIG. 7B explanatorily illustrates prevention of occurrence of capacitance with the conductive shield member.

In contrast to this, as illustrated in FIG. 7B, with the conductive shield member 600 interposed between the receiver 302 and the exterior 211, even when the user puts the hand 720 on the exterior 211, no capacitance 710 occurs between the hand 720 and the circuit board 700. Thus, the parasitic capacitances 711 and 712, respectively, between the circuit board 700 and the wired lines 701 and 702 remain in saturation, so that no noise is superimposed on the wired lines 701 and 702. Therefore, even when the hand 720 is put on the exterior 211, sheet double feed can be determined with accuracy.

[5] Modifications

The embodiment of the present invention has been described above. Needless to say, the present invention is not limited to the embodiment, and thus the following modifications can be carried out.

(5-1) In the embodiment, the exemplary case has been given in which the transmitter 301 and the receiver 302 are opposed to each other across the conveyance guide 203, the receiver 302 is disposed between the conveyance guide 203 and the exterior 211, and the travel route of the ultrasonic wave 303 from the transmitter 301 to the receiver 302 is orthogonal to the sheet principal plane. Needless to say, the present invention is not limited to this. Instead of this, the following may be applied.

Figure 8A:
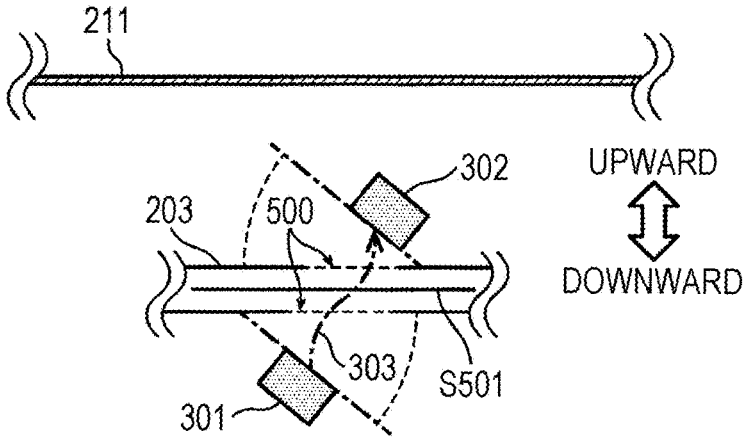
FIG. 8A explanatorily illustrates the position of arrangement of the transmitter and the receiver according to a modification of the present invention, in which the travel route of an ultrasonic wave obliquely crosses a sheet principal plane.
Figure 8B:
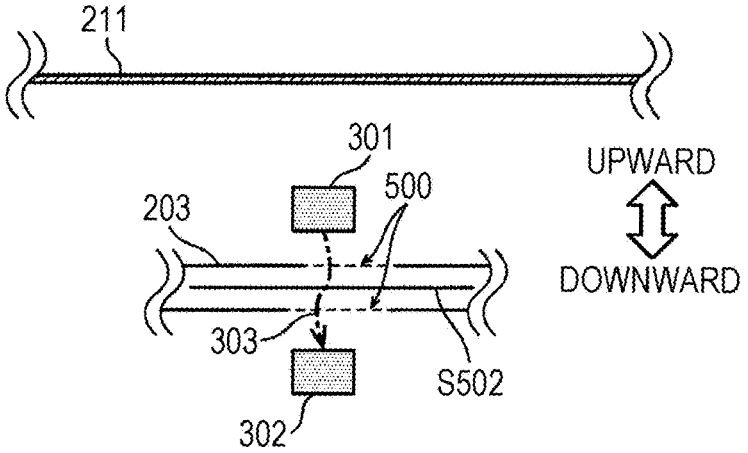
FIG. 8B explanatorily illustrates the position of arrangement of the transmitter and the receiver according to a modification of the present invention, in which the transmitter is arranged between a conveyance guide and an exterior.

For example, as illustrated in FIG. 8A, the transmitter 301 and the receiver 302 may be disposed such that the travel route of the ultrasonic wave 303 from the transmitter 301 to the receiver 302 obliquely crosses the sheet principal plane. As illustrated in FIG. 8B, instead of the receiver 302, the transmitter 301 may be disposed between the conveyance guide 203 and the exterior 211. Even in a case where the transmitter 301 and the receiver 302 are disposed as above, as long as the conductive shield member 600 is arranged between the receiver 302 and the exterior 211 in the sheet-face perpendicular direction (upward and downward direction) at the ultrasonic-irradiation position to a sheet S501 or S502 being conveyed and additionally the conductive shield member 600 is sufficiently larger than the receiver 302 in plan view in the sheet-face perpendicular direction, the accuracy of determination of sheet double feed can be retained high.

Figure 8C:
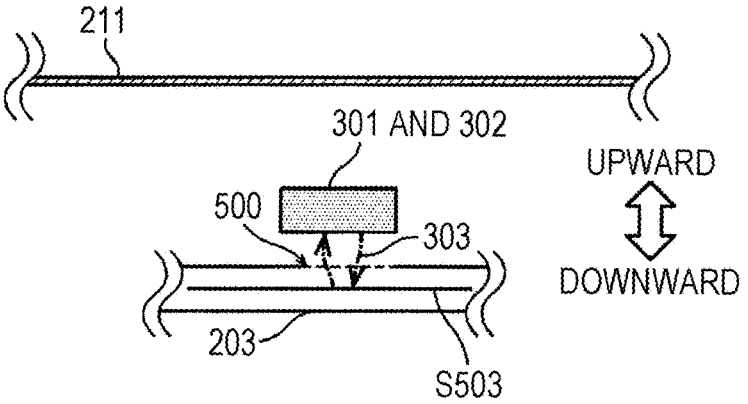
FIG. 8C explanatorily illustrates the position of arrangement of the transmitter and the receiver according to a modification of the present invention, in which the transmitter and the receiver are arranged together between the conveyance guide and the exterior.

Furthermore, as illustrated in FIG. 8C, even in a case where the transmitter 301 and the receiver 302 are arranged on the same side with respect to the conveyance guide 203 and the presence or absence of double feed is determined from the intensity of the ultrasonic wave 303 reflected from a sheet, as long as the conductive shield member 600 is arranged between the receiver 302 and the exterior 211 in the sheet-face perpendicular direction (upward and downward direction) at the ultrasonic-irradiation position to a sheet S503 being conveyed and additionally the conductive shield member 600 is sufficiently larger than the receiver 302 in plan view in the sheet-face perpendicular direction, the accuracy of determination of sheet double feed can be retained high. Even in a case where the transmitter 301 and the receiver 302 are integrally formed, similar provision of the conductive shield member 600 enables acquisition of a similar effect.

(5-2) In the embodiment, the exemplary case has been given in which the conductive shield member 600 is provided between the receiver 302 and the exterior 211. Needless to say, the present invention is not limited to this. Instead of this or in addition to this, the following may be applied.

Figure 9A:
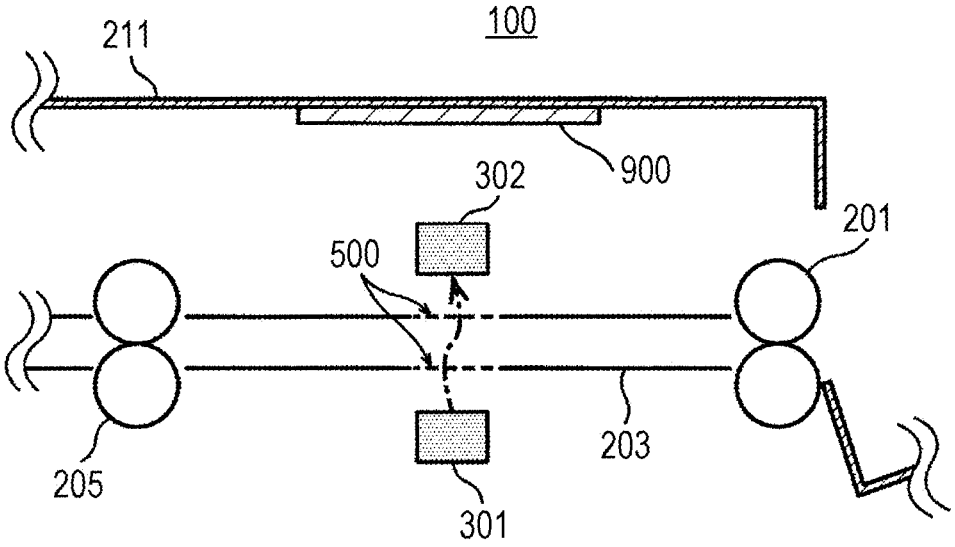
FIG. 9A illustrates a case where the surface of the exterior is applied with a conductive coat, instead of the conductive shield member.

For example, as illustrated in FIG. 9A, instead of the conductive shield member 600, a conductive coat 900 may be applied to the surface of the exterior 211. Particularly, in a case where the conductive coat 900 is applied to the outer face of the exterior 211, the conductive coat 900 may be identical in color to the exterior 211 or may be different in color from the exterior 211 in consideration of the exterior 211 in design. This arrangement enables acquisition of an effect similar to that in the embodiment.

Figure 9B:
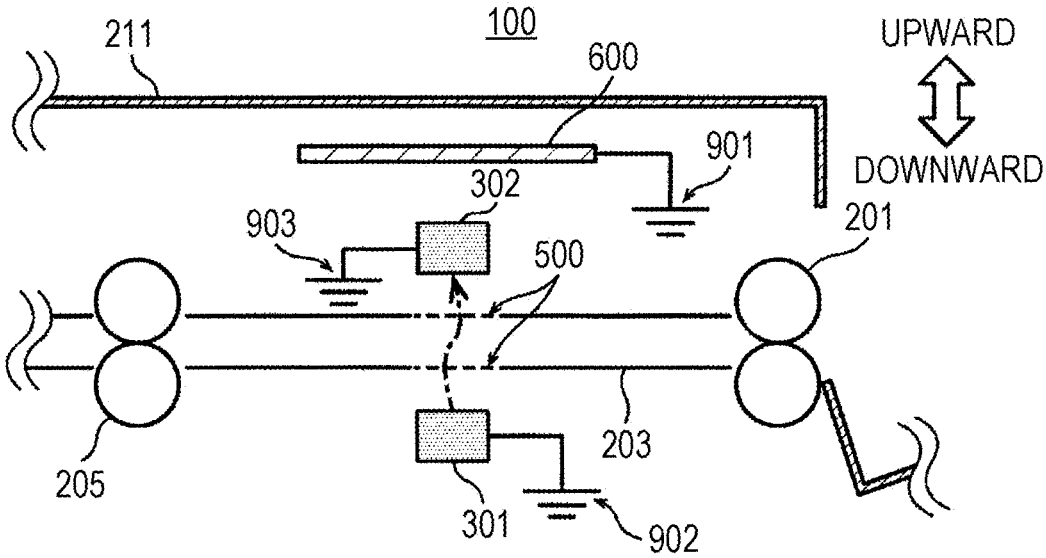
FIG. 9B illustrates a case where the conductive shield member, the transmitter, and the receiver are electrically grounded at a casing GND.

As illustrated in FIG. 9B, the conductive shield member 600, the transmitter 301, and the receiver 302 may be electrically grounded at the casing GND of the sheet conveyance apparatus 100 through grounded circuits 901, 902, and 903, respectively. This arrangement enables further enhancement of the effect of inhibiting noise.

(5-3) In the embodiment, the exemplary case has been given in which the conductive shield member 600 is provided between the conveyance guide 203 and the exterior 211. Needless to say, the present invention is not limited to this. Instead of this, the following may be applied.

Figure 10A:
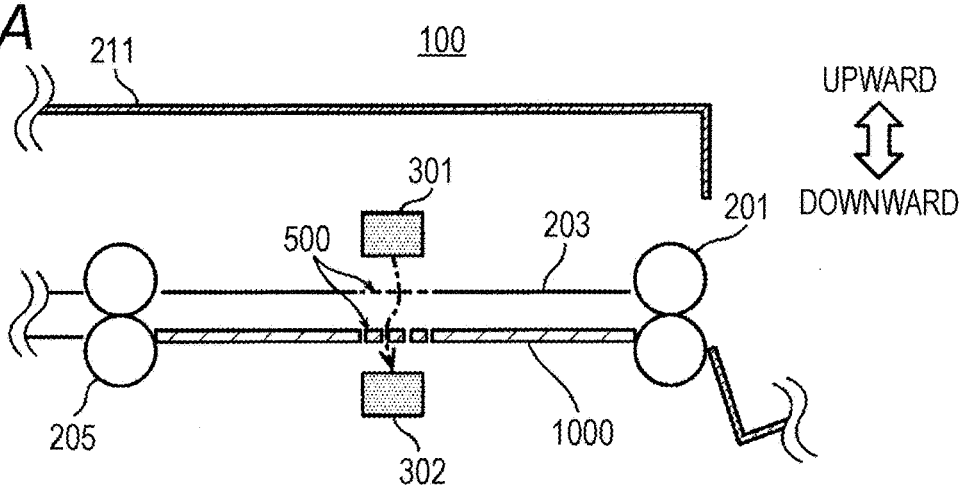
FIG. 10A illustrates a case where part of the conveyance guide is a conductive shield member.

For example, as illustrated in FIG. 10A, in a case where the receiver 302 is arranged below the conveyance guide 203, a portion of the conveyance guide 203 opposed to the receiver 302 may be provided as a conductive shield member 1000. The portion of the conveyance guide 203 opposed to the receiver 302 is located between the receiver 302 and the exterior 211 in the sheet-face perpendicular direction (upward and downward direction) at the ultrasonic-irradiation position to a sheet being conveyed (not illustrated). The conductive shield member 1000 disposed between the receiver 302 and the exterior 211 as above shields against influence from the outside of the sheet conveyance apparatus 100, so that sheet double feed can be detected with accuracy.

Figure 10B:
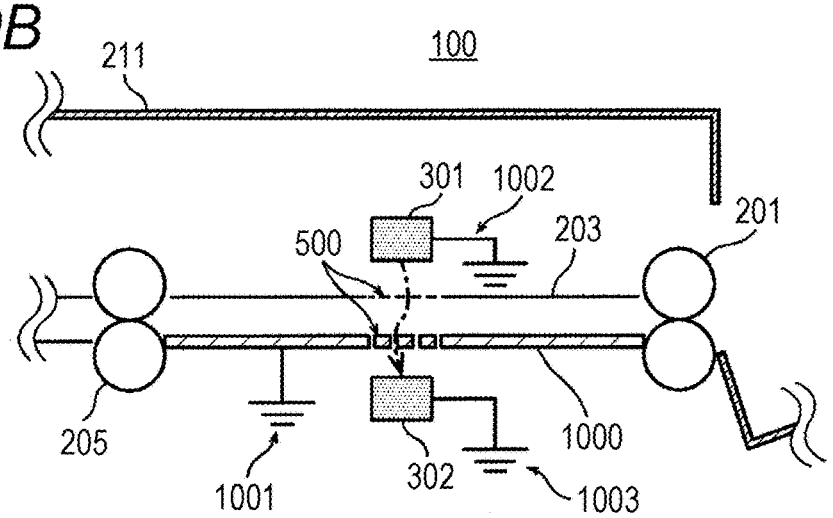
FIG. 10B illustrates a case where the conductive shield member, the transmitter, and the receiver in FIG. 10A are electrically grounded at the casing GND.

Furthermore, as illustrated in FIG. 10B, the conductive shield member 1000, the transmitter 301, and the receiver 302 may be electrically grounded at the casing GND of the sheet conveyance apparatus 100 through grounded circuits 1001, 1002, and 1003, respectively. This arrangement enables further enhancement of the effect of inhibiting noise.

Figure 10C:
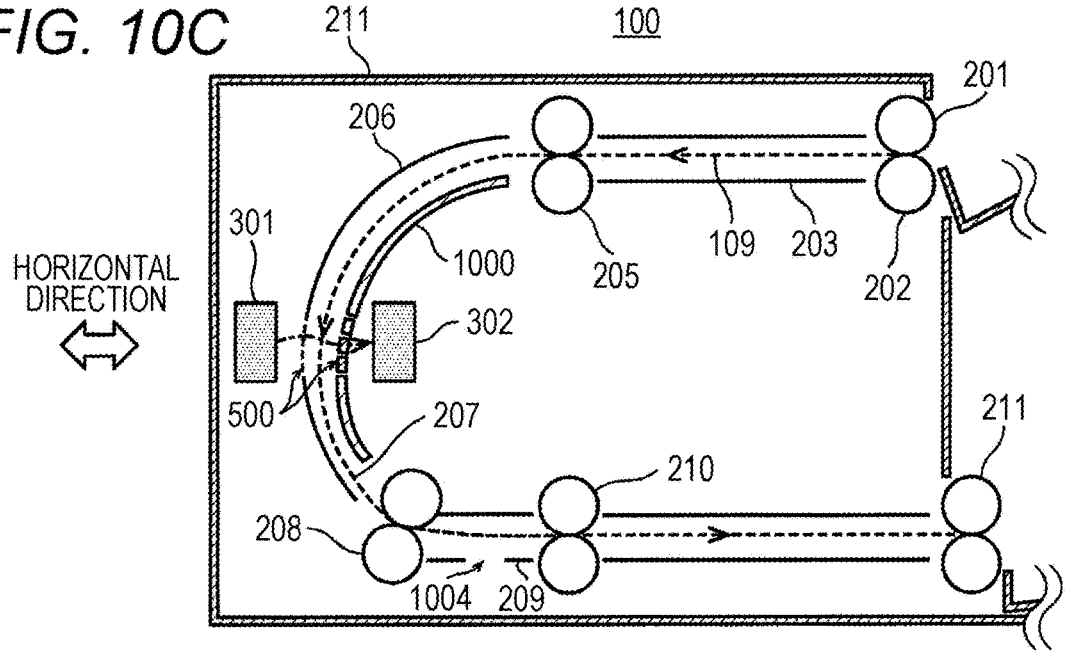
FIG. 10C illustrates a case where part of a conveyance guide is the conductive shield member in an apparatus configuration in which double-feed detection is performed on the downstream side of paired registration rollers and on the upstream side of a sheet reading position in the direction of sheet conveyance.

(5-4) In the embodiment, the exemplary case has been given in which sheet double feed is detected on the upstream side in the direction of sheet conveyance of the paired registration rollers 205. Needless to say, the present invention is not limited to this. Instead of this, the following may be applied. For example, as illustrated in FIG. 10C, sheet double feed may be detected on the downstream side in the direction of sheet conveyance of the paired registration rollers 205 and on the upstream side of a sheet reading position 1004.

In this case, a portion of the conveyance guide 206 opposed to the receiver 302 may be provided as the conductive shield member 1000. The portion of the conveyance guide 206 opposed to the receiver 302 is located between the receiver 302 and the exterior 211 in the sheet-face perpendicular direction (horizontal direction) at the ultrasonic-irradiation position to a sheet being conveyed (not illustrated). In a case where the conductive shield member 1000 curves such that the receiver 302 is surrounded from the nearest side of the exterior 211 to the receiver 302, effective shielding can be achieved against influence from the outside of the sheet conveyance apparatus 100.

(5-5) In the embodiment, the exemplary case has been given in which the conductive shield member 600 is tabular. Needless to say, the present invention is not limited to this. Instead of this, the following may be applied.

Figure 11A:
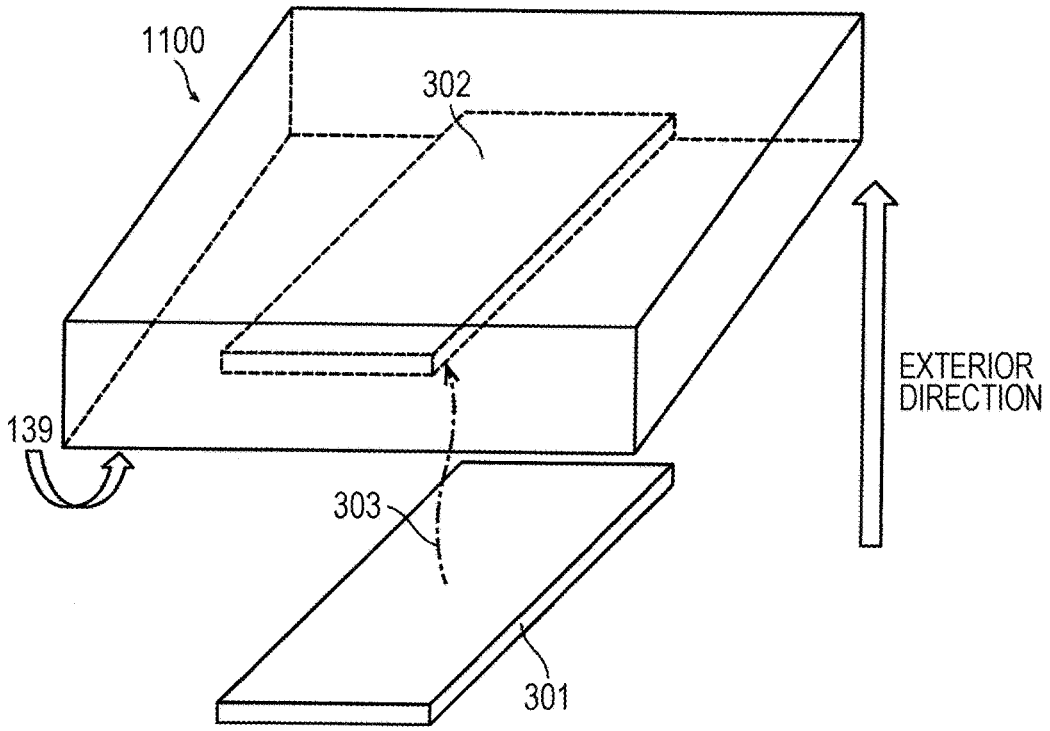
FIG. 11A illustrates a case where one face of the six faces of a boxy conductive shield member is removed for an opening.

For example, as illustrated in FIG. 11A, a boxy conductive shield member 1100 may be used in which a face of the six faces of the conductive shield member 1100 is removed for an opening through which the ultrasonic wave 303 passes. The conductive shield member 1100 as above can shield more effectively against influence from the outside of the sheet conveyance apparatus 100 than the tabular conductive shield member 600.

Figure 11B:
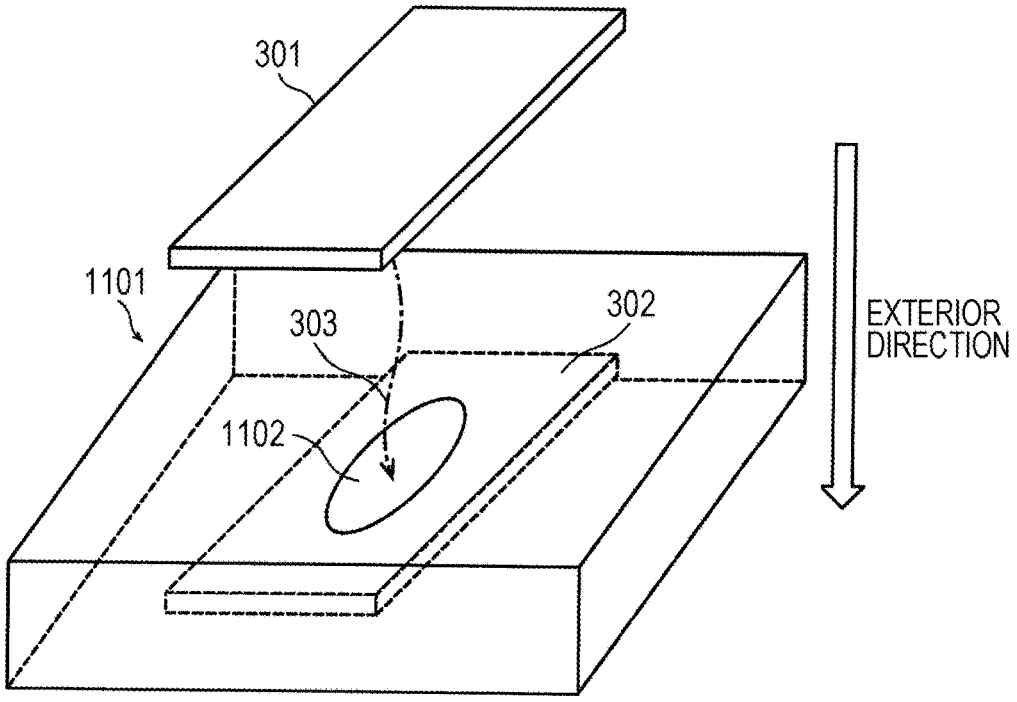
FIG. 11B illustrates a case where a through hole is provided at one face of the six faces of the boxy conductive shield member.

As illustrated in FIG. 11B, a conductive shield member 1101 surrounding the receiver 302 may be used, in which a through hole 1102 is provided at a portion through which the ultrasonic wave 303 passes. In this case, the number of through holes 1102 may be one or at least two. This arrangement enables influence from outside to be more reliably excluded.

(5-6) In the embodiment, the exemplary case has been given in which the transmitter 301 and the receiver 302 are each spaced apart from the conductive shield member 600. Needless to say, the present invention is not limited to this. Instead of this, the following may be applied. For example, the conductive shield member 600 may double as an attachment member that secures either the transmitter 301 or the receiver 302 to the sheet conveyance apparatus 100. This arrangement enables reduction in the number of components and omission of a space for attachment of the transmitter 301 or the receiver 302, in comparison to a case where an attachment member is provided separately from the conductive shield member 600.

(5-7) Although not specified in the embodiment, the double-feed detection sensor 300 may serve to detect the thickness of a sheet or detect whether an object being conveying is an envelope, in addition to detection of sheet double feed. Even in a case where, instead of the double-feed detection sensor 300, a sensor that performs similar detection with an ultrasonic wave is arranged, application of the present invention enables acquisition of a similar effect.

Note that, as the thickness of a sheet increases, the intensity of the ultrasonic wave that passes through the sheet decreases. Thus, detection of the intensity enables detection of the thickness of the sheet. From the viewpoint of transmission of the ultrasonic wave, an envelope is similar to two overlapping sheets. Similarly to detection of double feed, it can be determined whether an object being conveyed is an envelope, with reference to the intensity of the ultrasonic wave having passed through the envelope.

(5-8) In the embodiment, the exemplary case has been given in which the sheet conveyance apparatus 100 conveys a sheet (document) to be read by the image reader 110. Needless to say, the present invention is not limited to this. Instead of this or in addition to this, the following may be applied.

Figure 12:
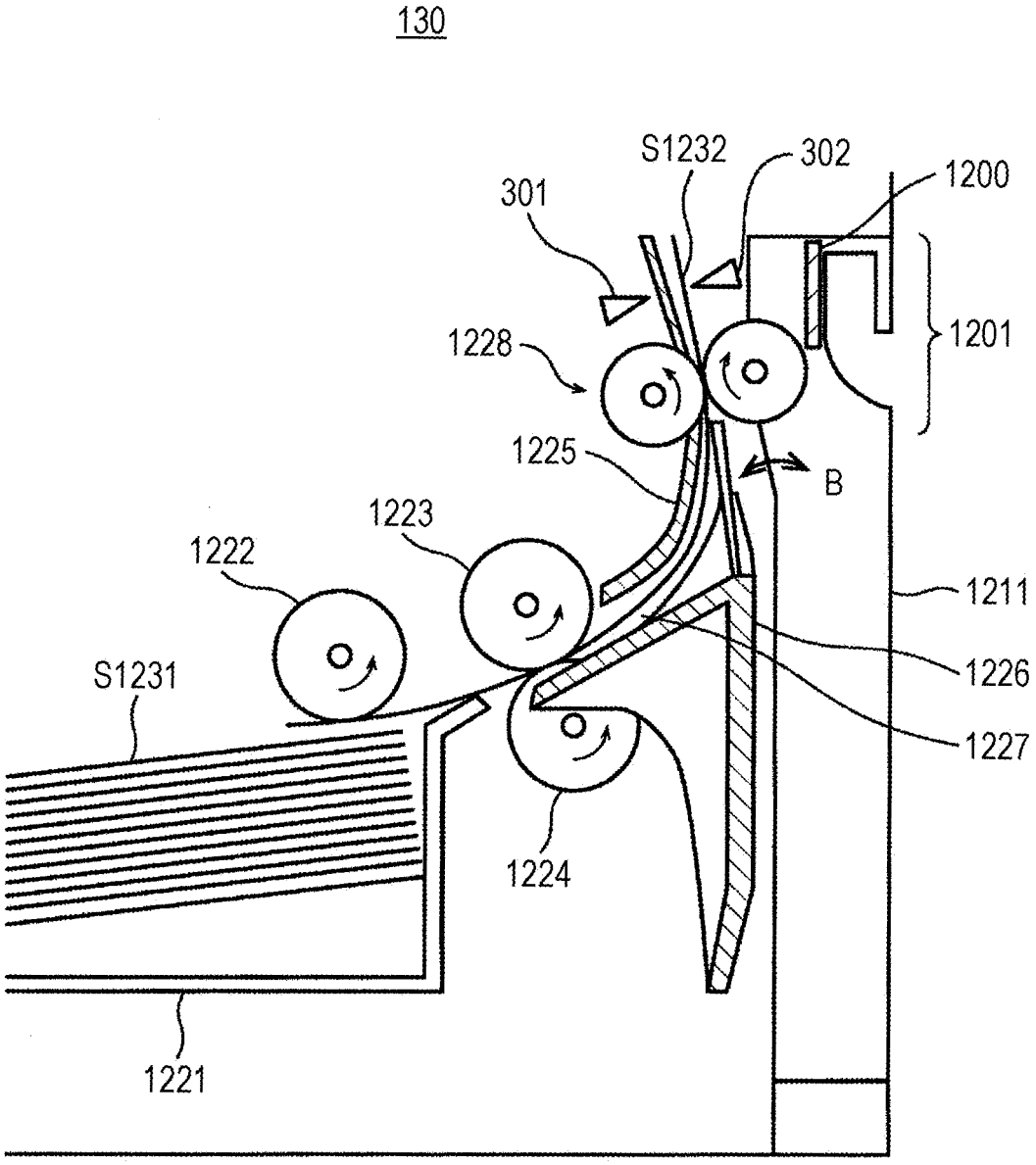
FIG. 12 illustrates the configuration of a paper feeder according to a modification of the present invention.

For example, in a case where the paper feeder 130 supplies a recording sheet for use in image forming in the multi-function peripheral 1, the presence or absence of double feed is detected with the double-feed detection sensor. For example, as illustrated in FIG. 12, a pick-up roller 1222 feeds a recording sheet from a sheaf of recording sheets S1231 housed in a paper cassette 1221 detachably attached to the paper feeder 130. Then, the recording sheet is guided between a feed roller 1223 and a separation roller 1224.

Furthermore, the recording sheet is conveyed along a route of sheet conveyance 1227 formed of conveyance guides 1225 and 1226, and then is fed to the image former 120 by paired conveyance rollers 1228. The transmitter 301 and the receiver 302 included in the double-feed detection sensor are opposed to each other across the route of sheet conveyance 1227, on the downstream side in the direction of sheet conveyance of the paired conveyance rollers 1228.

In a case where the recording sheet is jammed on the route of sheet conveyance 1227, when a door for jam processing 1211 is pivotally opened in the direction of an arrow B, the conveyance guide 1226 is pivoted together with the door for jam processing 1211. Thus, the recording sheet on the route of sheet conveyance 1227 can be accessed for removal from the outside of the multi-function peripheral 1.

The door for jam processing 1211 is provided with a handle 1201. A jam-processing operator operates the handle 1201 to open and close the door for jam processing 1211. A conductive shield member 1200 is arranged on the inner side of the handle 1201 to the multi-function peripheral 1. That is the conductive shield member 1200 is arranged between the receiver 302 and the handle 1201 corresponding to part of the housing of the multi-function peripheral 1, in the sheet-face perpendicular direction at the ultrasonic-irradiation position to a sheet S1232 being conveyed. This configuration enables the accuracy of double-feed detection to be prevented from deteriorating, with shielding against external influence to the receiver 302.

Particularly, because the user often moves a hand close to or touches the handle 1201 with a hand, the conductive shield member 1200 provided at the position corresponding to the handle 1201 can effectively prevent the accuracy of double-feed detection from deteriorating.

(5-9) In the embodiment, the exemplary case has been given in which the exterior 211 of the sheet conveyance apparatus 100 is substantially tabular near the receiver 302. However, in general, the exterior 211 is not necessarily tabular in shape. Thus, in many cases, the exterior 211 is intricate in shape. In consideration of an object of the present invention, preferably, the conductive shield member 600 is arranged between a position possible closest to the receiver 302 with part of the body of the user, such as a hand of the user, in contact with the surface of the exterior 211 during double-feed detection and part of the receiver 302 closest to the position. In plan view from the position to the part, preferably, the size of the conductive shield member 600 covers at least the entirety of the receiver 302.

From the viewpoint of practical use, the conductive shield member 600 may be arranged between a position to be most frequently touched by the user during double-feed detection on the surface of the exterior 211 and part of the receiver 302 closest to the position. In this case, in plan view from the position to the part, preferably, the size of the conductive shield member 600 covers at least the entirety of the receiver 302.

(5-10) Needless to say, downsizing of the sheet conveyance apparatus 100 causes the distance between the receiver 302 and the exterior 211 to shorten. Even in a case where the sheet conveyance apparatus 100 is not downsized, it may be advantageous to arrange the receiver 302 close to the exterior 211. In that case, application of the present invention enables acquisition of a similar effect.

(5-11) In the embodiment, the exemplary case has been given in which the image forming apparatus is a so-called multi-function peripheral. Needless to say, the present invention is not limited to this. Thus, application of the present invention to an image reading apparatus, such as a scanner, including a sheet conveyance apparatus or application of the present invention to an image forming apparatus, such as a copier or a facsimile machine, including a sheet conveyance apparatus, enables acquisition of a similar effect.

The sheet conveyance apparatus, the image reading apparatus, and the image forming apparatus according to the embodiment of the present invention usefully enable detection of sheet double feed with accuracy regardless of apparatus downsizing.

Although embodiments of the present invention have been described and illustrated in detail, the disclosed embodiments are made for purposes of illustration and example only and not limitation. The scope of the present invention should be interpreted by terms of the appended claims.

What is claimed is:

1. A sheet conveyance apparatus armored with a housing, the sheet conveyance apparatus comprising:

a sheet conveyor that feeds a sheet to a downstream side in a direction of conveyance;

a conveyance guide that guides the sheet to be conveyed;

an ultrasonic sensor that detects the sheet guided by the conveyance guide; and a shield member that is conductive, wherein the ultrasonic sensor includes:

a transmitter that transmits an ultrasonic wave having a predetermined frequency; and a receiver that receives the ultrasonic wave, the transmitter and the receiver are arranged along the conveyance guide, and the shield member is disposed between the housing and the receiver in a sheet-face perpendicular direction at an ultrasonic-irradiation position of the sheet being conveyed, the shield member covering an entirety of the receiver in plan view in the sheet-face perpendicular direction.

2. The sheet conveyance apparatus according to claim 1, wherein the receiver is disposed closer to the shield member than the transmitter is in the sheet-face perpendicular direction.

3. The sheet conveyance apparatus according to claim 1, wherein the transmitter is disposed closer to the shield member than the receiver is in the sheet-face perpendicular direction.

4. The sheet conveyance apparatus according to claim 1, wherein the conveyance guide doubles as the shield member.

5. The sheet conveyance apparatus according to claim 1, wherein the shield member is electrically grounded.

6. The sheet conveyance apparatus according to claim 1, wherein the shield member shields the receiver in the sheet-face perpendicular direction and in at least one direction different from the sheet-face perpendicular direction.

7. The sheet conveyance apparatus according to claim 1, wherein the shield member has a through hole on a travel route of the ultrasonic wave from the transmitter to the receiver.

8. The sheet conveyance apparatus according to claim 1, wherein the shield member expands in width from a far side to a front side of the sheet conveyance apparatus.

9. The sheet conveyance apparatus according to claim 1, wherein the receiver is arranged so as to detect an ultrasonic wave reflected from the sheet, the ultrasonic wave being part of the ultrasonic wave transmitted by the transmitter.

10. The sheet conveyance apparatus according to claim 1, wherein the transmitter and the receiver are opposed to each other across a conveyance route of the sheet.

11. The sheet conveyance apparatus according to claim 1, wherein at least either the transmitter or the receiver is attached to the shield member.

12. The sheet conveyance apparatus according to claim 1, wherein the shield member is a conductive coat applied to the housing.

13. The sheet conveyance apparatus according to claim 1, wherein the sheet conveyance apparatus is supplied with power from an alternating-current automatic voltage regulator.

14. The sheet conveyance apparatus according to claim 1, further comprising:

a setter that sets sheets including the sheet; and a separator that sequentially separately feeds the sheets set by the setter.

15. The sheet conveyance apparatus according to claim 1, wherein part of the housing is a cover openable for jam processing of the sheet, and the shield member is attached to the cover.

16. An image forming apparatus comprising:

the sheet conveyance apparatus according to claim 15, wherein the image forming apparatus forms an image onto a recording sheet conveyed by the sheet conveyance apparatus, and the shield member is attached at a position corresponding to a handle of the cover.

17. An image reading apparatus comprising:

the sheet conveyance apparatus according to claim 1, wherein the image reading apparatus reads an image from a document conveyed by the sheet conveyance apparatus, to generate image data.

18. An image forming apparatus comprising:

the image reading apparatus according to claim 17, wherein the image forming apparatus forms an image, based on the image data generated by the image reading apparatus.

19. An image forming apparatus comprising:

the sheet conveyance apparatus according to claim 1, wherein the image forming apparatus forms an image onto a recording sheet conveyed by the sheet conveyance apparatus.

* * * * *